US005588881A

United States Patent [19]

Eggert et al.

[11] Patent Number: 5,588,881

[45] Date of Patent: Dec. 31, 1996

[54] CONNECTOR TERMINAL BLOCK WITH ELECTRONIC MODULE

[75] Inventors: Gerhard Eggert; Walter Hanning, both of Detmold; Uwe Fiene, Steinheim; Michael Schnatwinkel, Herford; Rudolf Steinmeier; Manfred Wilmes, both of Detmold, all of Germany

[73] Assignee: Weidmueller Interface GmbH & Co., Detmold, Germany

[21] Appl. No.: 544,482

[22] Filed: Oct. 18, 1995

[30] Foreign Application Priority Data

Oct. 31, 1994 [DE] Germany ..... 44 38 800.4

[51] Int. Cl.[6] ..... H01R 9/22

[52] U.S. Cl. ..... 439/709; 439/716; 439/922

[58] Field of Search ..... 439/709–712, 439/715–719, 723–729, 922

[56] References Cited

U.S. PATENT DOCUMENTS 5,049,094 9/1991 Heng et al. ..... 439/716
5,407,367 4/1995 Robertson ..... 439/716

FOREIGN PATENT DOCUMENTS 1238087 5/1971 Germany .
4121836 1/1993 Germany .

*Primary Examiner*—Khiem Nguyen
*Attorney, Agent, or Firm*—Laubscher & Laubscher

[57] ABSTRACT

A terminal block and removable electronic module assembly is provided having a movable disconnect member that is displaceable relative to the module between engaged and disengaged positions in which an electronic component carried by the module is electrically connected and disconnected, respectively, relative to terminals carried by the terminal block member. When the disconnect member is in the disconnect position, the electronic module may be tested by a test plug external of the module housing.

10 Claims, 2 Drawing Sheets

CONNECTOR TERMINAL BLOCK WITH ELECTRONIC MODULE

BACKGROUND OF THE INVENTION

1. Field of the Invention

This invention relates to electrical connector terminal block means including a terminal block, an electronic module removably mounted on the terminal block, and a disconnect member that is movable between engaged and disengaged positions relative to the module to electrically connect and disconnect an electronic component within the module from one or more terminals on the terminal block.

2. Brief Description of the Prior Art

As shown by the German patent No. DE 41 21 836 C2, it has been proposed in the prior art to provide an electrical connector terminal block with disconnect means located in the upper area of the module. It is thus clearly visible from above the wiring plane of the terminal block, but this arrangement requires that portions of the internal bus bar connecting means must run upwardly and outwardly an appreciable distance from the terminal block connectors. One must create a rather complex disconnect point for exclusively performing this disconnect function, and depending on the layout, one must provide plug connections in the housing of the module for receiving the test plug means.

The present invention was developed to avoid the drawbacks of the prior art and to improve the module disconnecting and testing operations with the least possible structural effort and with minimal space requirements.

SUMMARY OF THE INVENTION

Accordingly, a primary object of the invention is to provide an improved connector terminal block and electronic module assembly including disconnect means that are movably connected with the module housing for displacement between engaged and disengaged positions in which the module is engaged with terminals on the terminal block, and disengaged for testing by separate test plug means, respectively. Because the disconnect means now lies in the plug connection zone of the electronic module, the need of separate busbars that lead to a disconnect point and the like is avoided, especially since this disconnect means at the same time also performs plug connector functions for the electronics module and, by the way, also directly by itself makes it possible to plug the test plug in for the purpose of testing the electronic circuits and components of the module. When the electronic module is plugged in the terminal block and the disconnect means is in its closed position, an electrical plug connection at this point between the electronic module and the connecting terminal block is assured. When in the disconnect position, the electrical connection to the connecting terminal block is interrupted at this point and, by plugging the test plug into the disconnect means, one can perform the desired testing of the electronics in the module. When the electronic module is removed, the disconnect means continues to be fastened to the electronic module because it is retained on it.

According to a preferred embodiment of such a terminal connector block, there is provided a locking means that is operable between the disconnect means and the housing of the electronic module and that can be activated when the disconnect means is in the disengaged position by plugging the test plug in. In this way, one can reliably ensue that the disconnect member—perhaps as a result of plugging the test plug in for testing purposes—will not perhaps be forced back again into the engaged position.

According to another embodiment, the disconnect member, at least in one segment, extends along a lower outside-wall sector of the electronic module in the height direction and, in the lower terminal sector facing toward the connecting terminal block, carries the plug connectors of the electronic module. For this purpose, the plug connectors in the connecting terminal block are placed with regard to the electronic module relatively far outside so that the plug connectors can cooperate. This results in the advantage that using the connecting terminal block, one can use electronic modules with the disconnect means or electronic modules featuring a broader design without the disconnect means.

In another practical embodiment, the test plug connections are located in the top portion of the disconnect member. In this upper area, the separating piece can also be made in the form of a gripping means. In this way, one can achieve a sufficient interval toward the wiring level of the connecting terminal block so that the disconnect means will remain clearly visible and easy to handle and so that the testing plug can also be inserted in the separating piece in an easy and comfortable way, especially since said disconnect means will then after all be in the upper disconnect position.

BRIEF DESCRIPTION OF THE DRAWINGS

Other objects and advantages of the invention will become apparent from a study of the following specification when viewed in light of the accompanying drawings in which.

Detailed Description

Figure 1:
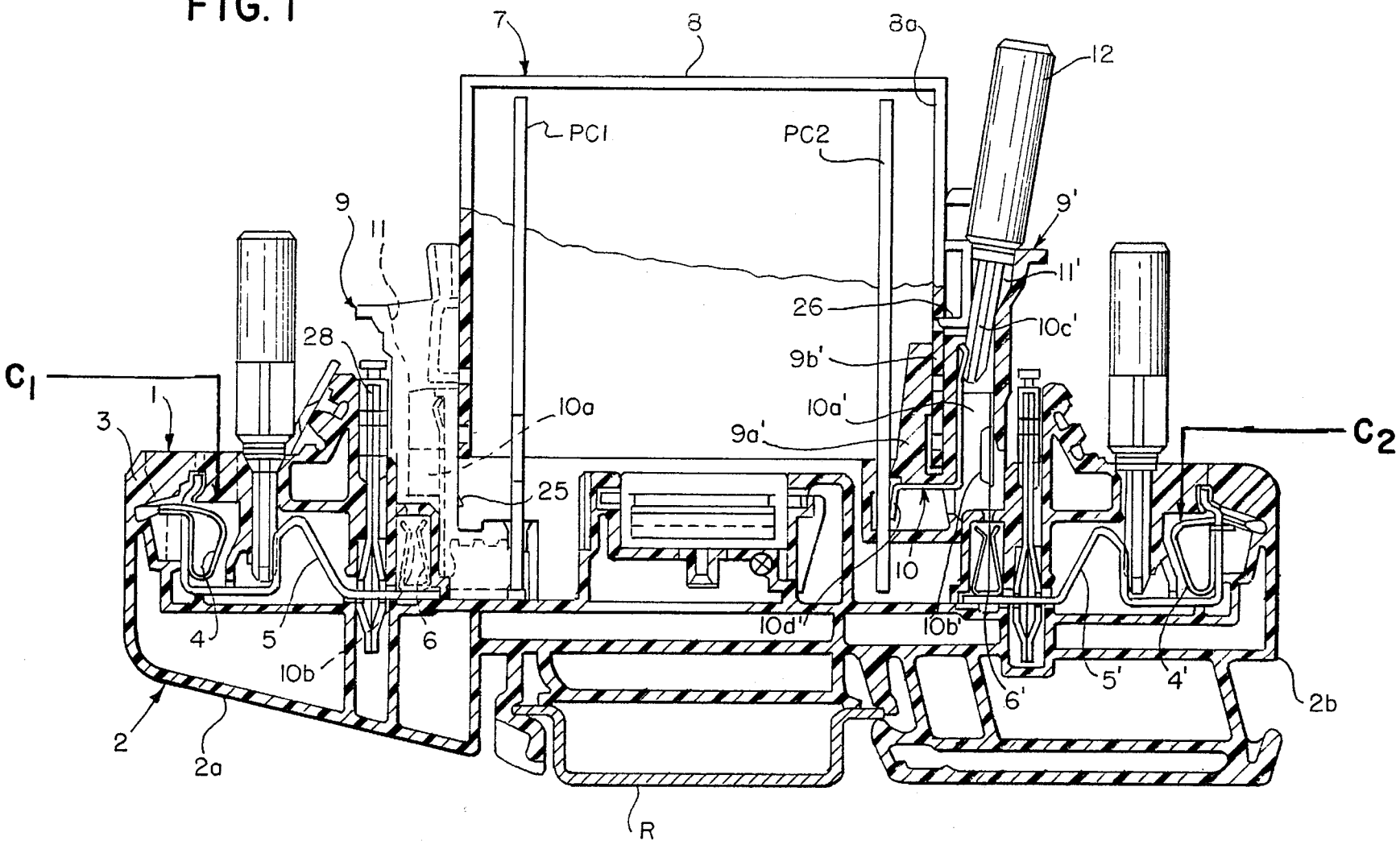
FIG. 1 is a sectional view of the assembly including the connector terminal block, the electronic module, and a pair of disconnect means in the engaged and disengaged positions, respectively.
Figure 2:
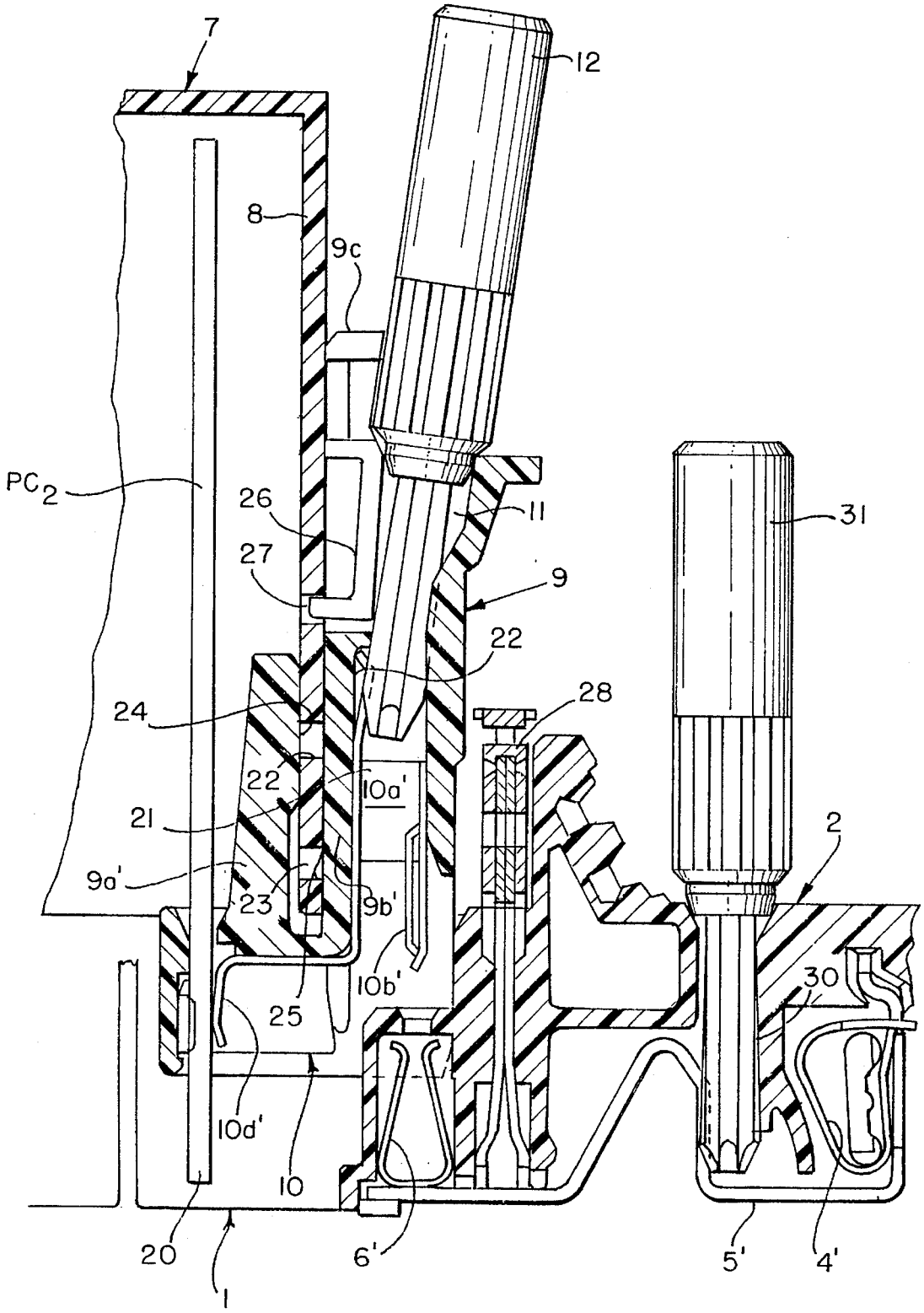
FIG. 2 is a detailed sectional view of the right hand disconnect means of FIG. 1.

Referring first more particularly to FIG. 1, the terminal block assembly means 1 includes a connector terminal block body 2 formed of a suitable synthetic plastic insulating material, which body supports at its opposite ends a pair of main terminals 4, 4'. Arranged on the terminal block body 2 between these main terminals are a pair of auxiliary terminals 6, 6' that are connected with the main terminal by busbars 5 and 5', respectively. Removably mounted on the terminal block body 2 is an electronic module 7 including a hollow housing 8 which contains electronic components, such as a pair of printed circuit boards PC1 and PC2. Mounted for sliding movement on opposite side walls **8*a* and 8*b* of the housing 8 are a pair of disconnect means 9 and 9' associated with the auxiliary terminals 6 and 6', respectively. Each of these disconnect members is vertically slidably movable relative to the associated sidewall 8*a* and 8*b* and associated auxiliary terminals 6 and 6', respectively. More particularly, the disconnect members include internal and external portions 9*a*, 9*b* and 9*a*', 9*b*' that are spaced to defined gaps 21 (FIG. 2) for receiving the lower extremities of the associated side wall 8*a* and 8*b*, respectively. As best shown in FIG. 2, the internal and external portions of the disconnect members 9 and 9' include hooks 24 and 24' that extend within corresponding recesses 22 and 22', and catches 25 and 25' that extend into corresponding recesses 23 and 23' thereby to maintain the disconnect member 9' in its engaged position illustrated in FIG. 2. These disconnect members are slidably mounted on the housing 8 of the electronic module 7** thereby to avoid loss of the disconnect members.

As shown in FIG. 2, the disconnect members carry at their lower ends a bridging terminal 10 that affords communication between the auxiliary terminal 6' and wiring on the printed circuit board PC2 via downwardly extending male terminal portion 10*b* that is arranged for insertion within the female auxiliary terminal 6'. The terminal 10 also includes an upwardly directed test portion 10*c*, and a second downwardly directed bridging portion 10*d* that engages the adjacent surface of the printed circuit board PC 2. Thus, current from conductor $C_2$ is supplied to printed circuit board PC2 via main terminal 4', busbar 5', auxiliary terminal 6', and the bridging terminal 10. Similarly, at the other end, current from conductor $C_1$ is supplied to printed circuit board PC1 via main terminal 4, busbar 5, auxiliary terminal 6, and bridging terminal 10.

In accordance with an important feature of the invention, when the disconnect member 9, 9' is raised to the disengaged position of FIG. 2, the test plug 12 may be inserted within the bore 11 contained in the top of the disconnect member 9' into electrical engagement with the upwardly extending portion 10*c* of the bridging terminal 10, as shown in FIG. 2. In order to prevent downward movement of the disconnect member 9' from its illustrated upper disengaged position by the test probe 121, a resilient locking member 26 is provided having an outwardly directed projection that is forced into a corresponding locking recess 27 contained in the housing wall 8*a*. Furthermore, owing to the spacing distance between the main terminals 4 and 4' and the auxiliary terminals 6 and 6', it is possible to test the busbars 5 and 5', respectively by test plugs 31 and 31' that extend downwardly within corresponding openings 30 contained in the connector terminal body.

A plurality of the terminal block bodies may be mounted on the support rail R in side-by-side manner as is conventional in the art. Successive terminal block assemblies may be connected by transverse connecting bars 28 and 28' that extend between the connector terminal blocks.

By arranging the auxiliary terminals 6 externally of the housing of the electronic module 7, the terminal block may be equipped with other electronic modules without the use of separate disconnect means. These electronic modules would then be so wide that the functional ends of the printed circuit boards could be inserted directly within the auxiliary terminals 6 and 6', respectively. It is, of course, possible to provide an assembly having only one disconnect member, or to afford connections between the auxiliary terminals 6 and 6' via conducting means arranged in the module housing 8.

The disconnect members are provided at their upper ends with extensions 9*c* and 9*c'* that may be engaged by a suitable tool (such as a screwdriver) for elevating the disconnect members from their engaged positions toward their disengaged positions. The height of the disconnect members is such as to insure clear visibility and accessibility to the upper disconnect piece and for also supporting the wiring level of the connecting terminal block. Thus, one may test the disconnect means in spatial terms that are shifted laterally to corresponding connections 30'.

While in accordance with the provisions of the patent statutes the preferred forms and embodiments of the invention have been illustrated and described, it will be apparent to those skilled in the art that various changes may be made without deviating from the various concepts set forth above.

What is claimed is:

1. Terminal block means for supplying electrical power to, and for testing the operation of, an electronic plug-in module such as a printed circuit board, comprising;

(a) terminal block means (1), including:
  (1) a terminal block body (2) formed of insulating material;
  (2) at least one main electrical terminal (4,4') mounted on said terminal block body;
  (3) at least one auxiliary electrical terminal (6,6') mounted on said terminal block body in spaced relationship relative to said main terminal; and
  (4) at least one electrical connecting means (5,5') connecting said auxiliary terminal with said main terminal;

(b) electronic module means (7) removably mounted on said terminal block body, said module means including:
  (1) a hollow housing (8) having a generally planar wall portion (8*a*); and
  (2) at least one electronic component (PC1, PC2) mounted in said housing; and (c) disconnect means for alternately electrically connecting and disconnecting said electronic component with respect to said auxiliary terminal, including:
  (1) a disconnect body member (9, 9') movably connected with said housing wall portion for displacement between engaged and disengaged positions relative to said auxiliary terminal; and
  (2) disconnect terminal means (10, 10') mounted on said disconnect body member for electrically connecting said auxiliary terminal with said electrical component when said disconnect body member is in said engaged position, said disconnect terminal means being disconnected from said auxiliary terminal when said disconnect body is in the disengaged position.

2. Apparatus as defined in claim 1, wherein said disconnect terminal means includes a test portion (10*c*, 10*c'*) adapted for engagement by a test plug (12) when said disconnect member is in said disengaged position;
and further including;

(d) locking means (26) operable by the test plug for locking said disconnect member in said disconnect position.

3. Apparatus as defined in claim 1, wherein said disconnect member includes a portion (9*b*, 9b') external of said module housing, said disconnect terminal means being carried by said external portion and includes a first contact portion (10*b*, 10b') at the end thereof that is adjacent said auxiliary terminal.

4. Apparatus as defined in claim 3, wherein said disconnect terminal means includes a test portion (10*c*, 10*c'*) that is arranged on said disconnect member external portion at the end thereof that is remote from said first contact portion.

5. Apparatus as defined in claim 4, wherein said disconnect member includes an internal portion (9*a*, 9*a'*) that extends within said module housing, said internal and external portions defining therebetween a gap (21) receiving said housing wall portion; and further wherein said disconnect terminal means includes a third portion (10*d*, 10*d'*) that is in electrical engagement with said electronic module when said disconnect member is in the engaged position.

6. Apparatus as defined in claim 5, and further including cooperating catch means (22, 24; 23, 25) on said housing wall portion and on said disconnect member for retaining said disconnect member in said engaged and disengaged positions, respectively, relative to said terminal block body.

7. Apparatus as defined in claim 2, wherein said locking means comprises resilient latch means (26) mounted on said disconnect member, said housing containing an opening (27) opposite said latch means when said disconnect member is in the disengaged position, said latch means normally being biased toward the unlatched condition relative to said opening and being operable by a test plug (12) toward engagement with said opening, thereby to prevent shifting of said disconnect member by the test plug toward the engaged position.

8. Apparatus as defined in claim 1, wherein said terminal block means includes a pair of said auxiliary terminals (6,6') mounted in spaced relation on said terminal block body, a pair of said main terminals (4,4') mounted on said terminal block means on opposite sides of said auxiliary terminal means, and a pair of connecting means (5,5') electrically connecting said auxiliary terminals with said main terminals, respectively.

9. Apparatus as defined in claim 8, and further including rail means (R) for supporting a plurality of said terminal block bodies in side-by-side relation, and cross-connector means (28, 28') extending transversely between said terminal block bodies for connecting corresponding terminals thereof.

10. Apparatus as defined in claim 8, wherein said terminal block means includes means intermediate said main and auxiliary terminals, respectively, affording access to said electrical connecting means by further test probe means (31).

* * * * *